United States Patent [19]

Murphy

[11] Patent Number: 4,549,494

[45] Date of Patent: Oct. 29, 1985

[54] REVERSIBLE SHADOW MULTICOLORED TRAPUNTO

[76] Inventor: Marjorie M. Murphy, 6624 April Bayou, Biloxi, Miss. 39532

[21] Appl. No.: 506,905

[22] Filed: Jun. 23, 1983

[51] Int. Cl.[4] ..... D05C 1/08

[52] U.S. Cl. ..... 112/266.1; 112/417; 112/420; 28/164

[58] Field of Search ..... 112/266.1, 266.2, 262.1, 112/417, 420, 421, 439, 440, 441; 2/DIG. 2; 428/14, 39; 28/164

[56] References Cited

U.S. PATENT DOCUMENTS

| | | | |
|---|---|---|---|
| 1,924,935 | 8/1933 | Klein | 112/262.1 X |
| 2,106,819 | 2/1938 | Tavin et al. | 112/420 X |
| 2,141,560 | 12/1938 | Rudnick | 112/266.1 X |
| 2,629,195 | 2/1953 | Casha | 112/420 X |
| 3,040,332 | 6/1962 | Kleinwald | 112/266.1 X |
| 4,390,381 | 6/1983 | Lemmeyer | 428/39 X |

*Primary Examiner*—Werner H. Schroeder
*Assistant Examiner*—T. Graveline
*Attorney, Agent, or Firm*—Pravel, Gambrell, Hewitt & Kimball

[57] ABSTRACT

A method of forming reversible shadow multicolored trapunto provides a plurality of steps in order to form the design including first the lamination (i.e., arrangement in layers by stitching together) of a plurality of thin, sheer fabric layers preferably a first top sheer fabric layer and a second bottom sheer fabric layer. A stitched, bordered design is formed in the layered fabric, the stitched border laminating the multiple fabric layers together. The stitched, bordered design comprises a plurality of segmented areas, each surrounded by and defined by the stitching. A needle threaded with colored yarn is inserted through a first opening at one end portion of the fabric and into the space between the two fabric layers of a given segment, the needle forming the opening upon insertion. The segment is then traversed by the needle internally between the fabric layers. The needle is then withdrawn from a selected second opening in one of the fabric layers at the opposite end portion of the segment until the yarn occupies the space in the void between the fabric layers. Then the yarn is cut at the first and second openings and the openings are closed with the thumb or a needle.

9 Claims, 5 Drawing Figures

REVERSIBLE SHADOW MULTICOLORED TRAPUNTO

BACKGROUND OF THE INVENTION

1. Technical Field

The present invention relates to quilting designs and methods of forming quilting designs. More particularly, the present invention relates to an improved method of quilting which forms a reversible shadow trapunto design of multicolor. Even more particularly, the present invention relates to a method and apparatus for forming multicolored reversible shadow trapunto designs wherein the colors can be viewed on either side of the design, each side being an exact replica of the other.

2. General Background

Trapunto is a decorative quilted design in high relief worked through a plurality of layers of cloth by outlining the design in running stitch and padding it from the underside. Usually trapunto is padded from the underside by cutting the underside layer of cloth and stuffing it with wool or cotton "cord." Another method involves the threading of cord into the layers and leaving the tails of the design exposed on the rear side, that side which is not normally viewed.

GENERAL DISCUSSION OF THE PRESENT INVENTION

The present invention provides a method of forming reversible shadow multicolored trapunto including a plurality of steps in order to form the design. The first step includes first arranging in layers a plurality of thin fabric layers. The fabric layers preferably include a top sheer fabric layer and a bottom sheer fabric layer. A third fabric layer can be used in the form of a layer of batting. One or more of the fabric layers can be silk, batiste, or broadcloth. A stitched bordered design is formed in the layered fabric, the stitched border laminating the fabric layers together. The stitched bordered design comprises a plurality of segmented areas, each surrounded by and defined by the stitching. A needle threaded with colored yarn is inserted through a first opening at one end portion of the fabric and into the space between the two fabric layers of a given segment, the needle forming the opening upon insertion. The segment is then traversed by the needle internally between the fabric layers. The needle is withdrawn from a selected second opening in one of the fabric layers at the opposite end portion of the segment until the yarn occupies the space in the void between the fabric layers. Then the yarn is cut at the first and second openings and the openings are closed with the thumb or a needle.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

FIGS. 1–4 illustrate the preferred embodiment of the apparatus of the present invention designated generally by the numeral 10.

Figure 1:
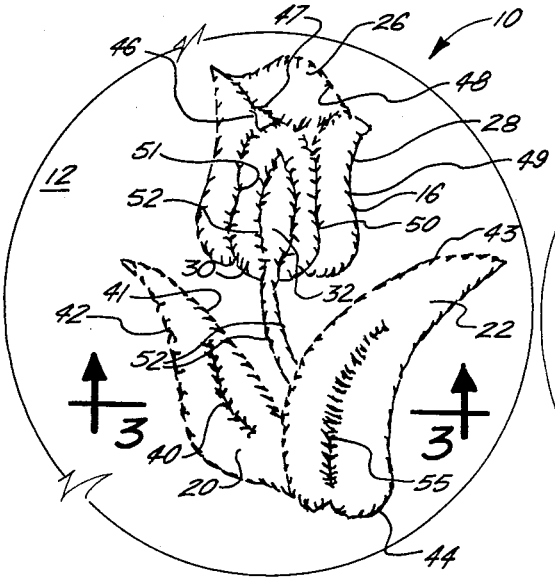
FIG. 1 is top view of the preferred embodiment of the apparatus of the present invention showing a typical design formed using the method of the present invention.
Figure 2:
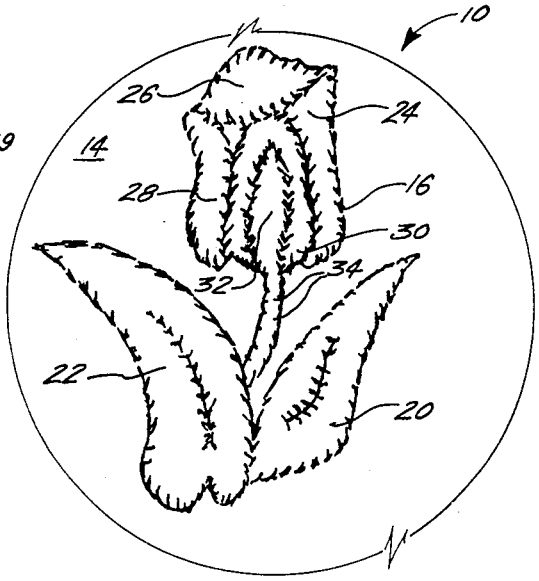
FIG. 2 is a bottom view of the preferred embodiment of the apparatus of the present invention showing a typical design formed using the method of the present invention.
Figure 3:
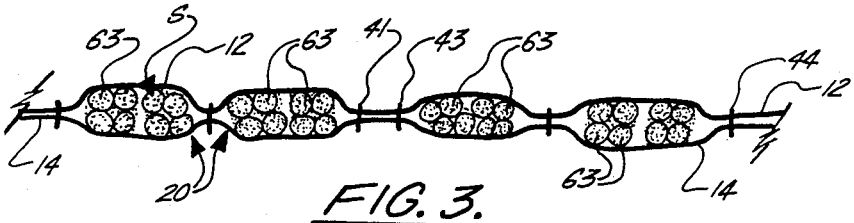
FIG. 3 is a sectional view taken along lines 3—3 of FIG. 1.
Figure 3A:
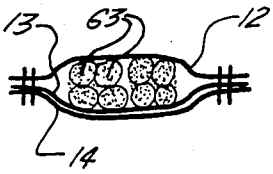
FIG. 3A is a partial sectional view of another embodiment of the multi-layered trapunto design formed by the method of the present invention.

Multicolored trapunto design 10 provides a top sheer fabric layer 12 and a bottom sheer fabric layer 14. A sheer fabric layer 12, 14 can be selected, for example, by placing a proposed fabric layer over a white paper sheet having strong black printing. If the print on the sheet is visible through the fabric, the fabric is sheer and can be used for the multicolored trapunto design 10. The fabric layers can be, for example, silk, batiste, broadcloth or the like. A third layer 13 of batting can be added if desired (see FIG. 3A). The fabric layers 12, 14 as best seen in FIG. 3 are laminated (i.e., arranged in layers) and then stitched together by a running stitch 16 which forms a desired outline that defines a design such as the flower seen in FIGS. 1, 2, and 4.

The outline of the design 10 is formed by a running stitch 16 which includes a number of segment areas 20–34. In the design 10 of FIGS. 1 and 2, the segment areas 20, 22 and 34 could be green, the segment areas 24 and 28 are pink, the segment areas 26 and 32 are lavender, and the segment area 30 is blue. These various segment areas are "colored" by filling each individual segment area with yarn of a desired color. One or more pieces of yarn are placed in the space S between fabric layers 12, 14 and as defined by the running stitch border which surrounds each segment area.

Segment area 20 is formed by running stitch borders 41, 42, while segment area 22 is formed by running stitch borders 43, 44. In the embodiment shown, the design is of a flower. Segment areas 20, 22 are the leaves of the flower and in this embodiment could be colored green as will be described more fully hereinafter. The segment areas 24, 26, 28, 30, and 32 form the petals of the flower while area 34 forms the stem.

Segment area 24 is formed by running stitch borders 45, 46. Segment area 26 is formed by running stitch borders 47, 48. Segment area 28 is formed by running stitch borders 49, 50. Segment area 30 is formed by running stitch borders 50, 51, and 52. Segment area 32 is formed by running stitch borders 52. Likewise segment area 34 is formed by running stitch border 52.

Figure 4:
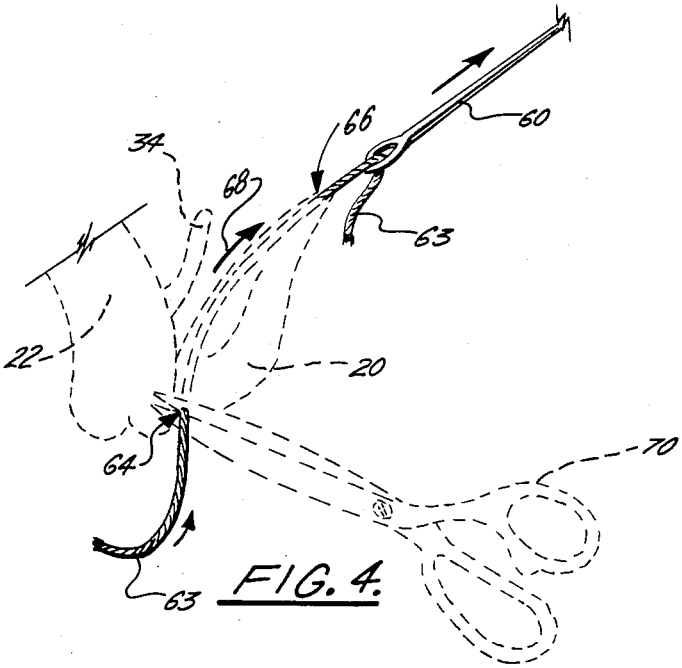
FIG. 4 is a schematic view illustrating placement of a single element of yarn in one of the segments of the design.

In FIG. 4, there can be seen a tapestry needle 60 which is threaded with an elongated piece of yarn 63 which would be colored. An entry opening 64 is formed by piercing the fabric with the needle at one end portion of one of the segment areas 20. The needle 60 with yarn 63 attached then traverses the entire length of the segment area between the fabric layers 12, 14 and through the space S until it reaches the opposite end portion of the segment area 20. At that point, a second exit opening 66 is formed by the point of the needle 60 and the yarn 63 exits the space S by penetrating one of the fabric layers at the opening 66 formed by needle 60.

As shown in FIG. 4, the yarn 63 extends the entire length of the design segment area 20. This process is repeated until one or more pieces of yarn 63 fill the segment area 20 causing it to have high relief as shown in FIG. 3. Each of the yarn pieces of yarn 63 is cut immediately adjacent the entry opening 64 and the exit opening 66. The yarn 63 once cut provides end portions or "tails" which are then pushed completely into the inner space S portion of the particular segment area 20 being filled. The openings 64, 66 are then closed using the needle 60. The seamstress or artisan can alternatively use a thumb or forefinger to close these openings. It should be understood that in this manner neither fabric layer 12, 14 is cut, altered, or in any way multilated or destroyed. This produces a completely reversible trapunto design with no visible trace of how the yarn was placed between the fabric layers 12, 14. The yarn 63 is completely contained within the space S between the fabric layers 12, 14 and within the confines of a particular segment area. The seamstress or artisan selects the length of yarn 63 needed for each segment area as well as the number of pieces of yarn needed to fill each segment area. More or less yarn can be applied to a given segment area depending upon the amount of color intensity desired, and the degree of high relief desired by the seamstress.

Trapunto design 10 can be produced of, for example, fabric materials including silk, broadcloth, batiste, and of polyester and cotten blends. Yarns can be 4-acrylics.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A method of forming reversible shadow multicolor trapunto designs comprising the steps of:

a. laminating a plurality of thin fabric layers, at least one of the fabric layers being sheer;

b. forming a stitched, bordered design in the laminated fabric layers defining a plurality of enclosed segmented areas, each having two or more fabric layers with a void therebetween surrounded by stitching;

c. inserting a needle threaded with an attached length of colored yarn into one layer of fabric at a first point of entry defining a first minute opening the thickness of the needle and into the space between the two fabric layers of a given segment;

d. traversing the segment between the fabric layers with the needle and the attached length of yarn so that the yarn follows the path of the needle;

e. withdrawing the needle and one end portion of the attached yarn from a second selected point of withdrawal on the segment defining a second minute opening the thickness of the needle, so that the attached yarn occupies space in the void between the fabric layers between the point of entry and the point of withdrawal formed by the needle; and f. cutting the ends of the yarn at the fabric surface adjacent the points of entry and withdrawal so as to leave an elongated middle portion of the yarn entirely within the stitched border of the design segment.

2. The method of claim 1 wherein three fabric layers are provided including two sheer fabric layers and one layer of batting.

3. The method of claim 1 wherein multiple pieces of yarn are placed in at lest one of the segments.

4. The method of claim 1 wherein at least one of the fabric layers is silk.

5. The method of claim 1 wherein at least one of the fabric layers is bastiste.

6. The method of claim 1 wherein at least one of the fabric layers is broadcloth.

7. The method of claim 1 wherein the yarn is an acrylic.

8. The method of claim 1 wherein each segmented area is filled with yarn of a single color and different segments in the overall design provide multiple colors.

9. The method of claim 1 wherein the first and second openings are closed, while pushing the end portions or "tails" of each piece of yarn back into the design space between the fabric layers of a given segment.

* * * * *